US008330753B2

(12) United States Patent
Chen

(10) Patent No.: US 8,330,753 B2
(45) Date of Patent: Dec. 11, 2012

(54) DRIVING METHOD AND DISPLAY UTILIZING THE SAME

(75) Inventor: Yi-Cheng Chen, Guishan Shiang (TW)

(73) Assignee: Industrial Technology Research Institute, Chutung (TW)

( * ) Notice: Subject to any disclaimer, the term of this patent is extended or adjusted under 35 U.S.C. 154(b) by 965 days.

(21) Appl. No.: 12/390,426

(22) Filed: Feb. 21, 2009

(65) Prior Publication Data

US 2010/0149150 A1 Jun. 17, 2010

(30) Foreign Application Priority Data

Dec. 12, 2008 (TW) ..... 97148455 A

(51) Int. Cl.
*G09G 5/00* (2006.01)
*G09G 3/28* (2006.01)

(52) U.S. Cl. ..... 345/211; 345/214; 345/60

(58) Field of Classification Search ..... None
See application file for complete search history.

(56) References Cited

U.S. PATENT DOCUMENTS 6,025,819 A * 2/2000 Xie et al. ..... 345/75.1
7,119,772 B2 * 10/2006 Amundson et al. ..... 345/87
7,492,339 B2 * 2/2009 Amundson ..... 345/87
7,952,557 B2 * 5/2011 Amundson et al. ..... 345/107
2001/0021033 A1 * 9/2001 Matsuda ..... 358/1.9
2005/0212747 A1 * 9/2005 Amundson ..... 345/107
2007/0075941 A1 * 4/2007 Zhou et al. ..... 345/84
2008/0048969 A1 * 2/2008 Whitesides et al. ..... 345/107
2009/0153757 A1 * 6/2009 Nose ..... 349/35
2010/0149150 A1 * 6/2010 Chen ..... 345/211

FOREIGN PATENT DOCUMENTS

CN 1938746 A 3/2007
WO WO 2005/036517 A1 4/2005
WO WO 2007/057797 A1 5/2007

OTHER PUBLICATIONS

Abstract of CN 1938746 in English, publication date Mar. 28, 2007.
Office Action of corresponding CN patent application, issued Apr. 15, 2011.

* cited by examiner

*Primary Examiner* — Peter Vincent Agustin
(74) *Attorney, Agent, or Firm* — Wang Law Firm, Inc.; Li K. Wang; Stephen Hsu

(57) ABSTRACT

A driving method for a display including a source driver and at least one pixel is disclosed. The source driver is activated to provide a first data signal to the pixel. The first data signal includes a first pulse. The source driver is activated to provide a second data signal to the pixel. The second data signal includes a second pulse. The width of the first pulse is different from the width of the second pulse and a gray level is composed of the first and the second pulses.

22 Claims, 8 Drawing Sheets

DRIVING METHOD AND DISPLAY UTILIZING THE SAME

CROSS REFERENCE TO RELATED APPLICATIONS

This Application claims priority of Taiwan Patent Application No. 97148455, filed on Dec. 12, 2008, the entirety of which is incorporated by reference herein.

BACKGROUND OF THE INVENTION

1. Field of the Invention

The invention relates to a driving method, and more particularly to a driving method for driving a display.

2. Description of the Related Art

Because cathode ray tubes (CRTs) are inexpensive and provide high definition, they are utilized extensively in televisions and computers. With technological development, new flat-panel displays are continually being developed. When a larger display panel is required, the weight of the flat-panel display does not substantially change when compared to CRT displays.

BRIEF SUMMARY OF THE INVENTION

Driving methods for a display are provided. An exemplary embodiment of a driving method for an electro-wetting display (EWD) comprising a source driver and at least one pixel is described in the following. The source driver is activated to provide a first data signal to the pixel. The first data signal comprises a first pulse. The source driver is activated to provide a second data signal to the pixel. The second data signal comprises a second pulse. The width or the polarity of the first pulse is different from the width or the polarity of the second pulse.

Another exemplary embodiment of a driving method for a display comprising a source driver and at least one pixel is described in the following. The source driver is activated to provide a first data signal to the pixel. The first data signal comprises a first pulse. The source driver is activated to provide a second data signal to the pixel. The second data signal comprises a second pulse. The width of the first pulse is different from the width of the second pulse and a gray level is composed of the first and the second pulses.

Displays are also provided. An exemplary embodiment of an electro-wetting display (EWD) comprises at least one pixel, a gate driver, and a source driver. The gate driver provides a gate signal to the pixel. The source driver provides a first data signal and a second data signal to the pixel. The first data signal comprises a first pulse. The second data signal comprises a second pulse. The width or the polarity of the first pulse is different from the width or the polarity of the second pulse.

Another exemplary embodiment of a display comprises at least one pixel, a gate driver, and a source driver. The gate driver provides a gate signal to the pixel. The source driver provides a first data signal and a second data signal to the pixel. The first data signal comprises a first pulse. The second data signal comprises a second pulse. The width of the first pulse is different from the width of the second pulse, and a gray level is composed of the first and the second pulses.

A detailed description is given in the following embodiments with reference to the accompanying drawings.

BRIEF DESCRIPTION OF THE DRAWINGS

The invention can be more fully understood by referring to the following detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
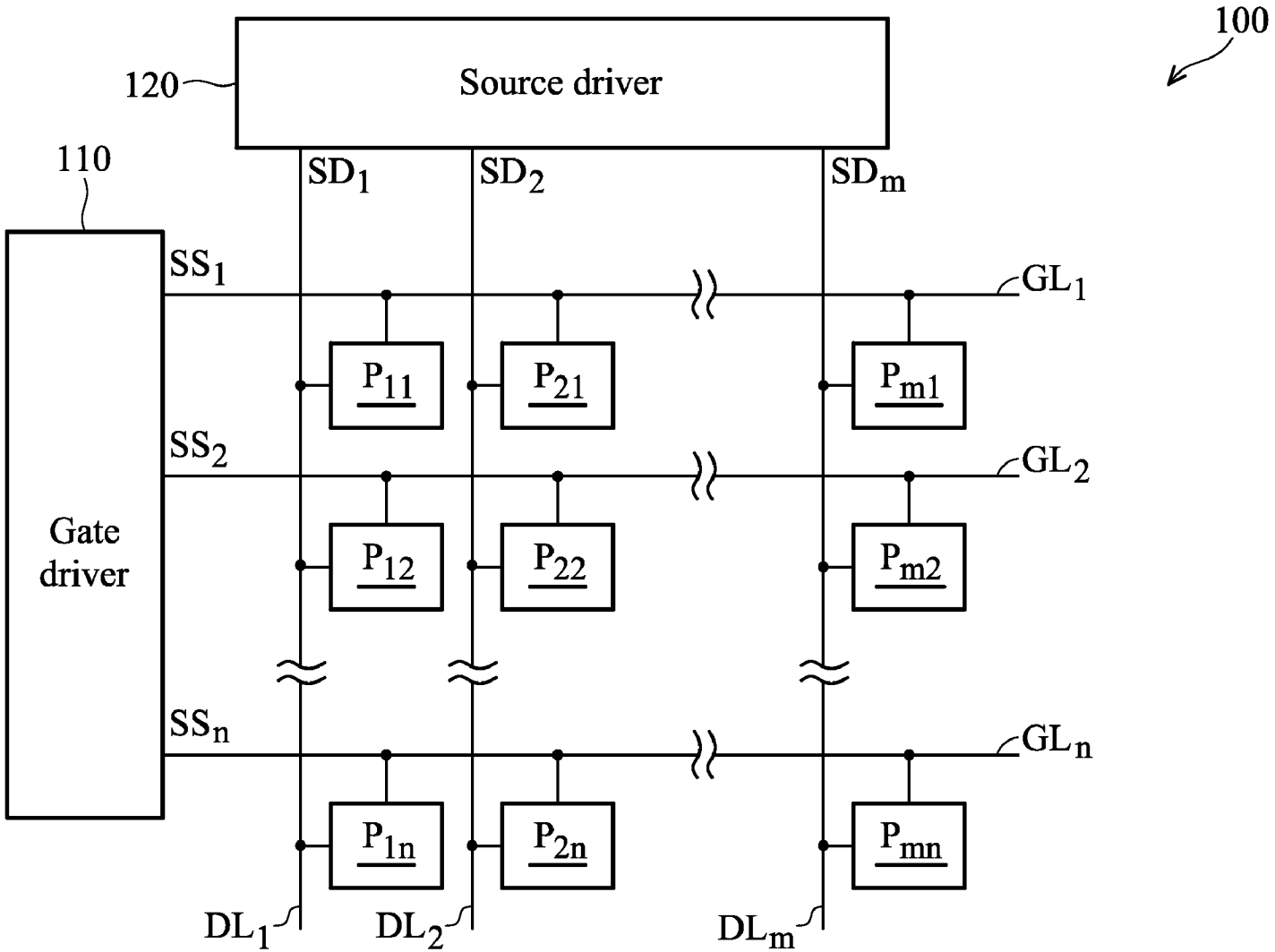
FIG. 1 is a schematic diagram of an exemplary embodiment of a display.

FIG. 1 is a schematic diagram of an exemplary embodiment of a display. The display 100 may be a liquid crystal display (LCD), a plasma display panel (PDP), or an electro-wetting display (EWD). The EWD possess the favorable advantages of low power consumption, high response speed, high contrast, and high reflectivity. In this embodiment, the display 100 comprises a gate driver 110, a source driver 120, and pixels $P_{11}$~$P_{mn}$.

The gate driver 110 provides scan signals $SS_1$—$SS_n$ to the pixels $P_{11}$~$P_{mn}$ via gate lines $GL_1$~$GL_n$. The source driver 120 provides data signals $SD_1$~$SD_m$ to the $P_{11}$~$P_{mn}$ via data lines $DL_1$~$DL_m$. The pixels $P_{11}$~$P_{mn}$ receive the data signals $SD_1$~$SD_m$ according to the scan signals $SS_1$~$SS_n$ and display the corresponding gray levels according to the data signals $SD_1$~$SD_m$. For clarity, the scan signal $SS_1$, the data signal $SD_1$, and the pixel $P_{11}$ are given as an example to describe the characteristic between the data signal $SD_1$ and the gray level displayed by the pixel $P_{11}$.

During a first period, the gate driver 110 activates the pixel $P_{11}$ via the scan signal $SS_1$. Thus, the pixel $P_{11}$ displays a corresponding gray level according to the data signal $SD_1$. At this time, the data signal $SD_1$ comprises a first pulse. During a second period, the gate driver 110 activates the pixel $P_{11}$ via the scan signal $SS_1$ again. Thus, the pixel $P_{11}$ displays another corresponding gray level according to the data signal $SD_1$ again. At this time, the data signal $SD_1$ comprises a second pulse.

In one embodiment, if the display 100 is a EWD, the width or the polarity of the first pulse is different from the width or the polarity of the second pulse. For example, when the width of the first pulse is different from the width of the second pulse, the polarity of the first pulse is the same as the polarity of the second pulse. In this case, the first pulse corresponds to a first gray level and the second pulse corresponds to a second gray level. When the polarity of the first pulse is different from the polarity of the second pulse and the width of the first pulse is the same as the width of the second pulse, a gray level is composed of the first and the second pulses.

In another embodiment, the width of the first pulse is different from the width of the second pulse and a gray level is composed of the first and the second pulses. The invention does not limit the width of the second pulse. The width of the second pulse may be longer than or shorter than the width of the first pulse.

Figure 2A:
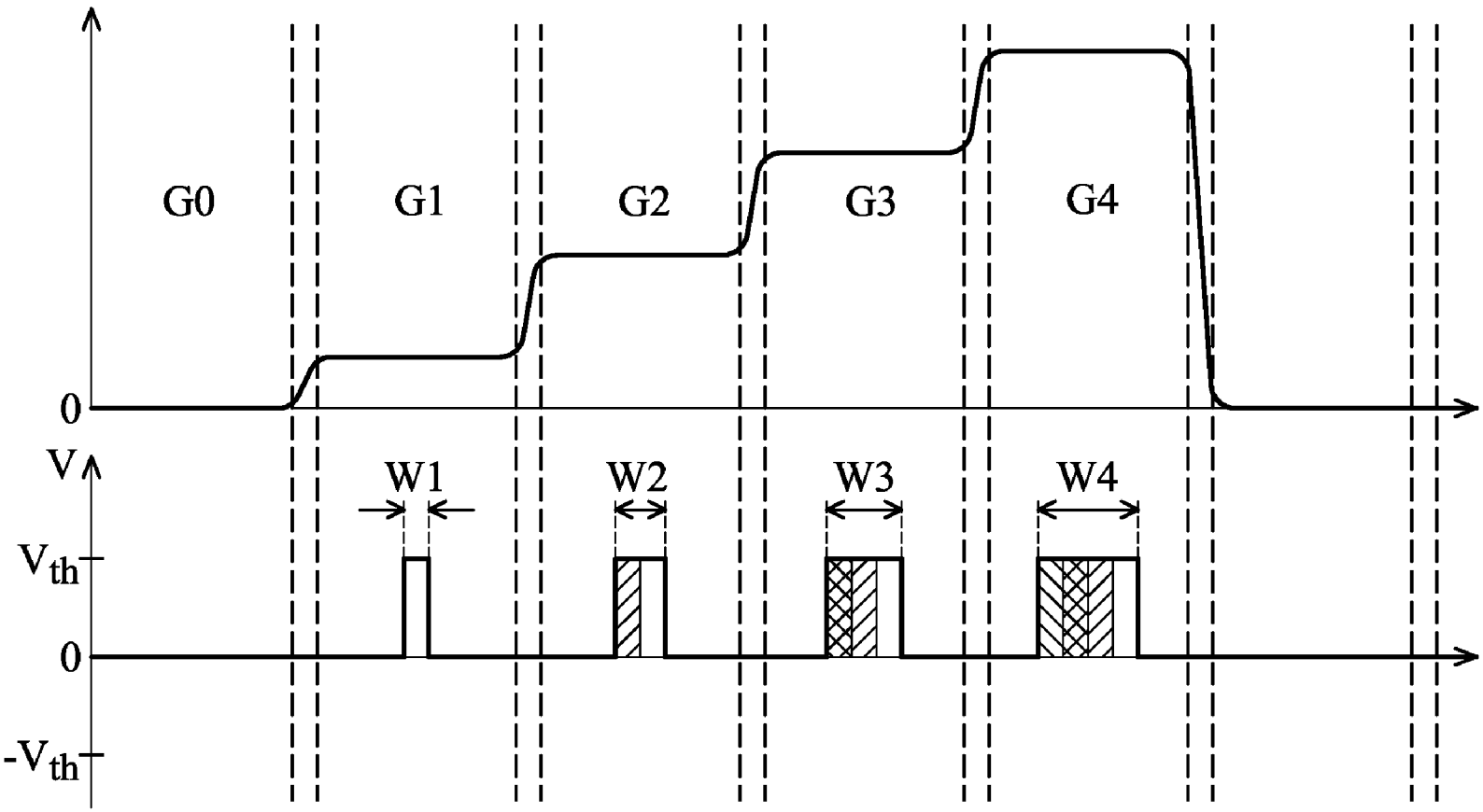
FIG. 2A shows a relationship between the data signal and the gray level.

FIG. 2A shows a relationship between the data signal and the gray level. The pulse width of the data signal is controlled to adjust the gray level. In this embodiment, the amount of the gray levels is 5. When a pixel receives a data signal and the data signal does not comprise a pulse, the pixel displays the gray level G0. When a pixel receives a data signal and the pulse of the data signal comprises a width W1, the pixel displays the gray level G1. When a pixel receives a data signal and the pulse of the data signal comprises a width W2, the pixel displays the gray level G2. When a pixel receives a data signal and the pulse of the data signal comprises a width W3, the pixel displays the gray level G3. When a pixel receives a data signal and the pulse of the data signal comprises a width W4, the pixel displays the gray level G4. In this embodiment, the relationship among the widths W1~W4 is W1<W2<W3<W4. In an embodiment, a multiple relationship exists among the widths W1~W4, but the disclosure is not limited thereto.

Figure 2B:
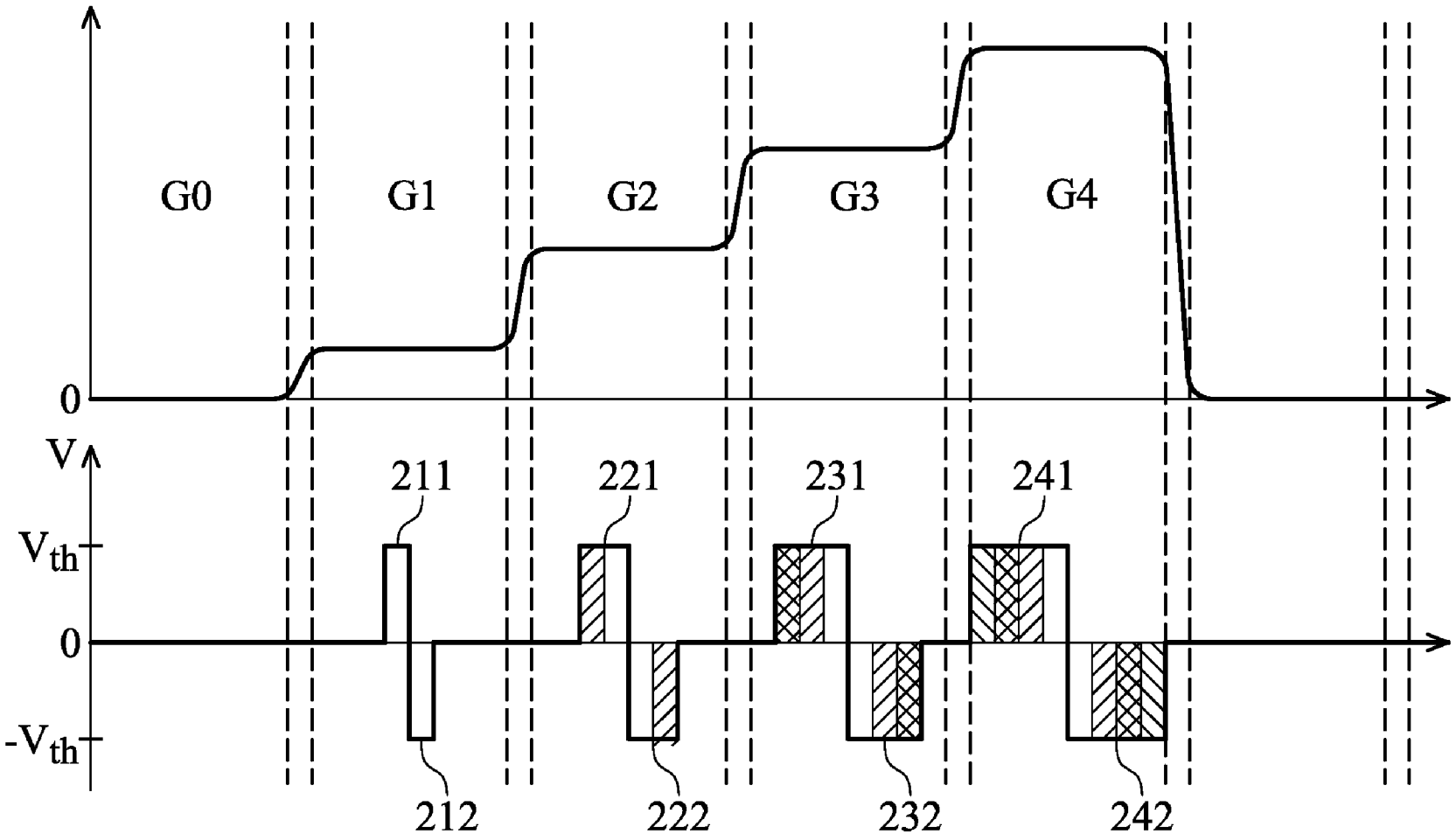
FIG. 2B shows another relationship between the data signal and the gray level.

FIG. 2B shows another relationship between the data signal and the gray level. In this embodiment, when a pixel is required to display a gray level, a data signal received by the pixel is composed of positive pulses and negative pulses. The positive pulses and negative pulse are alternately arranged to increase the life of the pixel. For example, if the pixel $P_{11}$ is required to display the gray level G1, a data signal received by the pixel $P_{11}$ comprises the pulses 211 and 212. The pulse 211 is a positive pulse and the pulse 212 is a negative pulse. The pulses 211 and 212 are alternately provided to the pixel $P_{11}$.

To define the polarity of the data signal, a common voltage is served as an offset. When a pulse is higher than the offset, the pulse is referred to as a positive pulse. In other words, the polarity of the pulse is positive. Oppositely, if a pulse is less than the offset, the pulse is referred to as a negative pulse. In other words, the polarity of the pulse is negative. In this embodiment, the common voltage comprises a direct current (DC) format. In some embodiments, the common voltage comprises an alternating current (AC) format. As shown in FIG. 2B, the polarities of the pulses 211, 221, 231, and 241 are positive and the polarities of the pulses 212, 222, 232, and 242 are negative.

Referring to FIG. 2B, for the same gray level, a symmetrical relationship arises between the width of the positive pulse and the width of the negative pulse. For example, the width of the pulse 211 is the same as the width of the pulse 212. The width of the pulse 221 is the same as the width of the pulse 222. The width of the pulse 231 is the same as the width of the pulse 232. The width of the pulse 241 is the same as the width of the pulse 242. In other embodiments, an asymmetric relationship may arise between the width of the positive pulse and the width of the negative pulse.

In this embodiment, the total width of the pulses 211 and 212 represents the gray level G1. The total width of the pulses 221 and 222 represents the gray level G2. The total width of the pulses 231 and 232 represents the gray level G3. The total width of the pulses 241 and 242 represents the gray level G4.

Figure 3A:
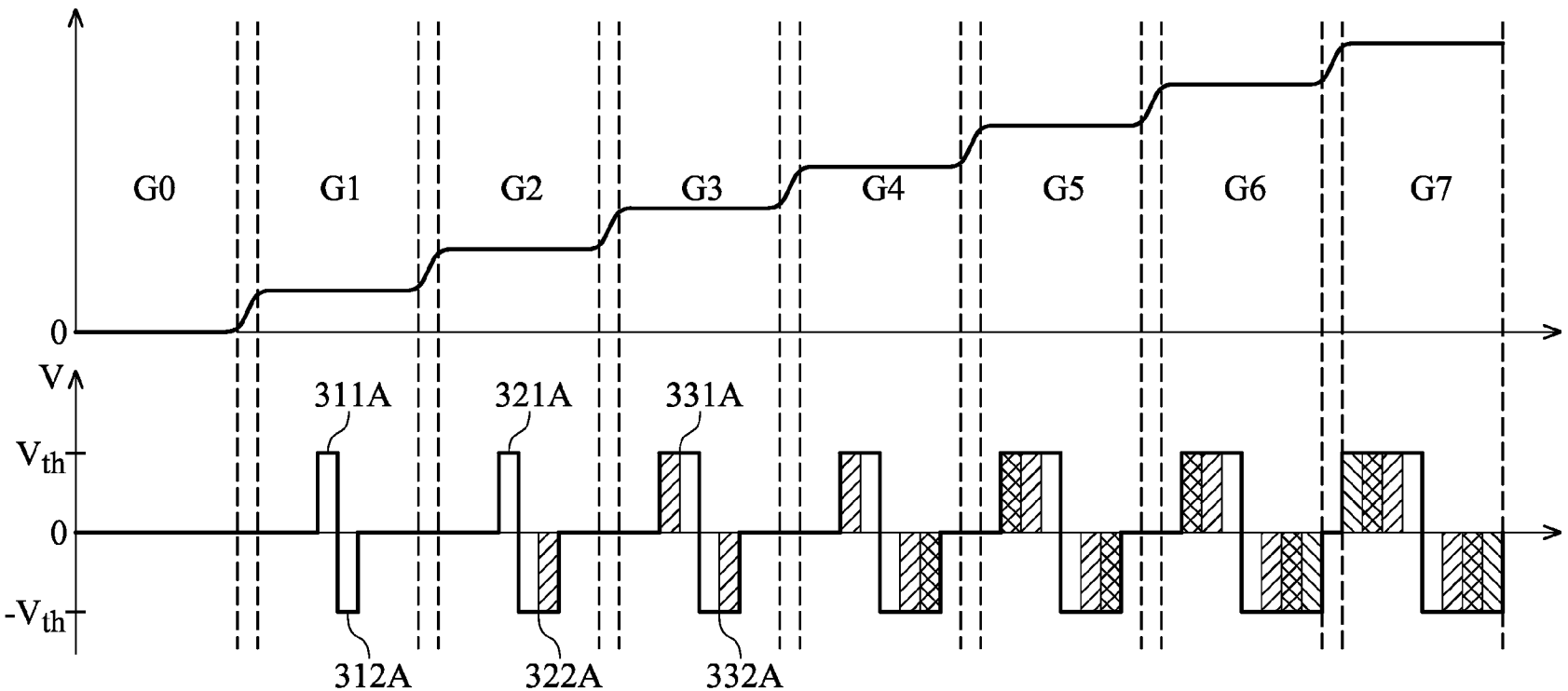
FIGS. 3A~3C show other relationships between the data signal and the gray level.

FIG. 3A shows another relationship between the data signal and the gray level. When the width of the pulse is controlled, the number of the gray levels can be increased. In this embodiment, a portion of the widths of the positive pulses are different from the corresponding widths of the negative pulse and another portion of the widths of the positive pulses are the same as the corresponding widths of the negative pulse.

To clarify, the gray levels G1~G3 are provided as an example. The total width of the pulses 311A and 312A represents the gray level G1. The total width of the pulses 321A and 322A represents the gray level G2. The total width of the pulses 331A and 332A represents the gray level G3. As shown in FIG. 3A, the width of the pulse 311A is the same as the width of the pulse 312A. The width of the pulse 321A is different from the width of the pulse 322A. The width of the pulse 331A is the same as the width of the pulse 332A.

In another embodiment, the width of the pulse 321A may be the same as the width of the pulse 322A and the width of the pulse 331A may be different from the width of the pulse 332A. In some embodiments, the width of each positive pulse may be different from the width of the corresponding negative pulse.

Furthermore, for the gray levels G1 and G2, the width of the pulse 311A is the same as the width of the pulse 312A and the width of the pulse 322A is longer than the width of the pulse 312A. For the gray levels G2 and G3, the width of the pulse 331A is longer than the width of the pulse 321A and the width of the pulse 332A is the same as the width of the pulse 322A. The described width relationship between the positive pulse and the negative pulse is not limited thereto. Those skilled in the field can utilize other width relationships to replace the above width relationships.

Figure 3B:
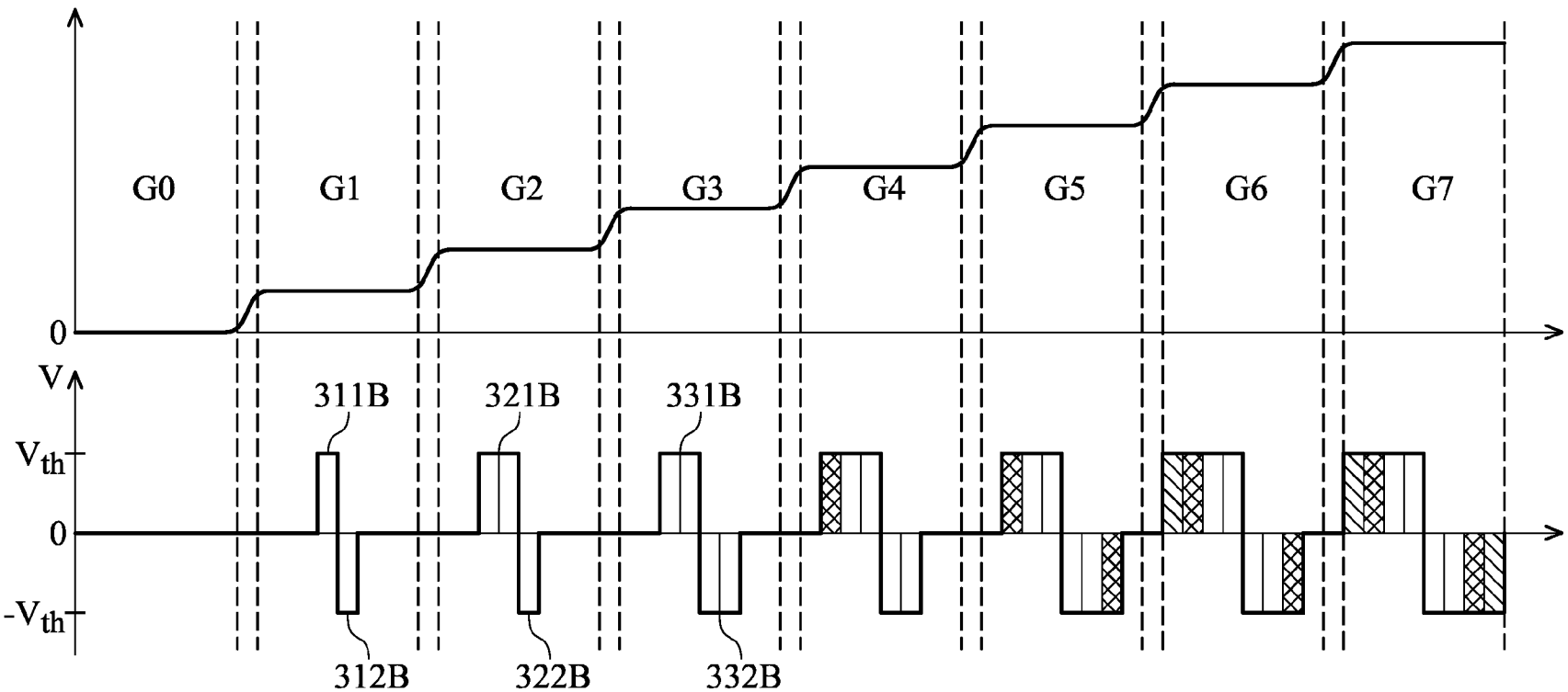

FIG. 3B shows another relationship between the data signal and the gray level. In this embodiment, the width of the pulse 321B is different from the width of the pulse 311B and the width of the pulse 321B is longer than the width of the pulse 322B. Additionally, the width of the pulse 331B is the same as the width of the pulse 321B and the width of the pulse 331B is different from the width of the pulse 322B.

In this embodiment, for the gray levels G1 and G2, the width of the pulse 321B is longer than the width of the pulse 311B and the width of the pulse 322B is the same as the width of the pulse 312B. For the gray levels G2 and G3, the width of the pulse 331B is the same as the width of the pulse 321B and the width of the pulse 332B is longer than the width of the pulse 322B. Similarly, those skilled in the field can utilize other width relationships to replace the width relationship as shown in FIG. 3B.

Figure 3C:
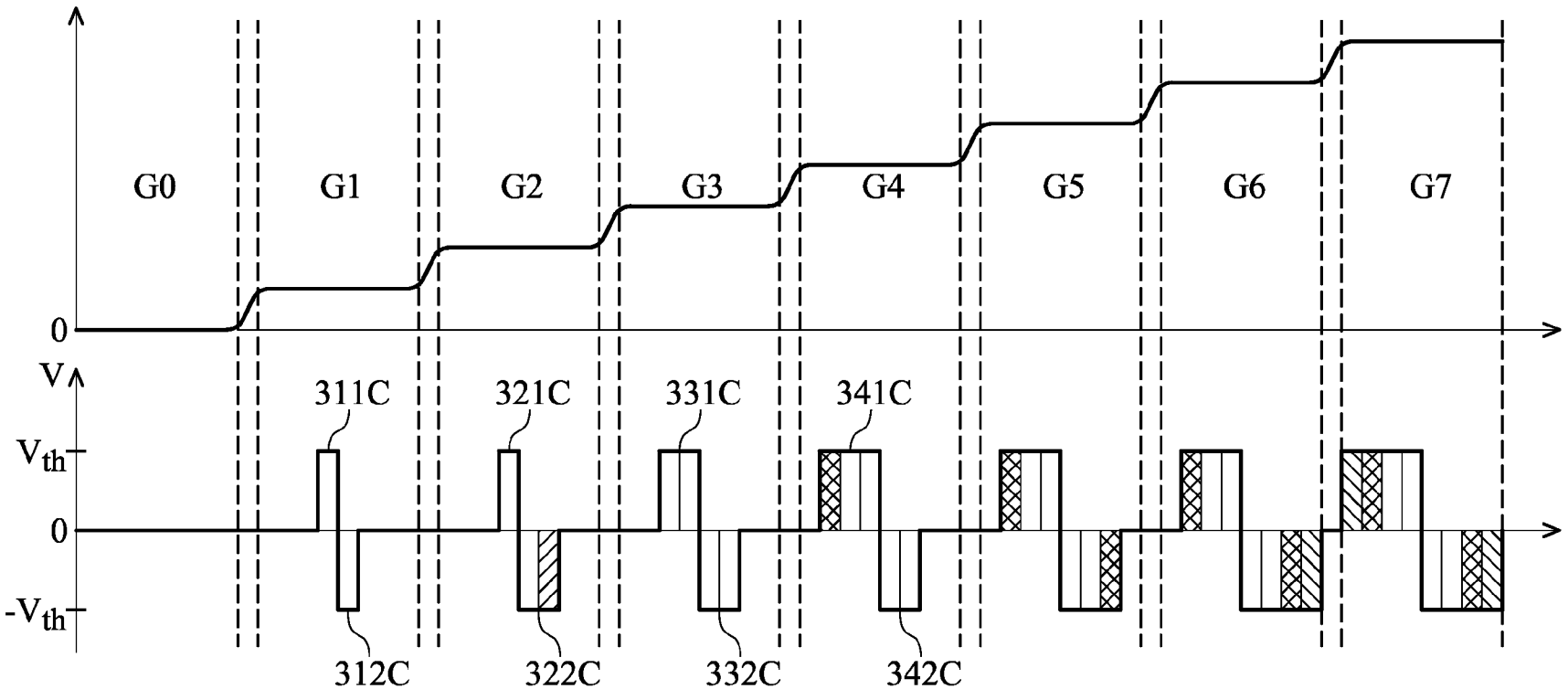

FIG. 3C shows another relationship between the data signal and the gray level. In this embodiment, for the gray levels G1 and G2, the width of the pulse 311C is the same as the width of the pulse 321C and the width of the pulse 322C is longer than the width of the pulse 312C. For the gray levels G2 and G3, the width of the pulse 331C is longer than the width of the pulse 321C and the width of the pulse 332C is the same as the width of the pulse 322C. For the gray levels G3 and G4, the width of the pulse 341C is longer than the width of the pulse 331C and the width of the pulse 342C is the same as the width of the pulse 322C.

Figure 4A:
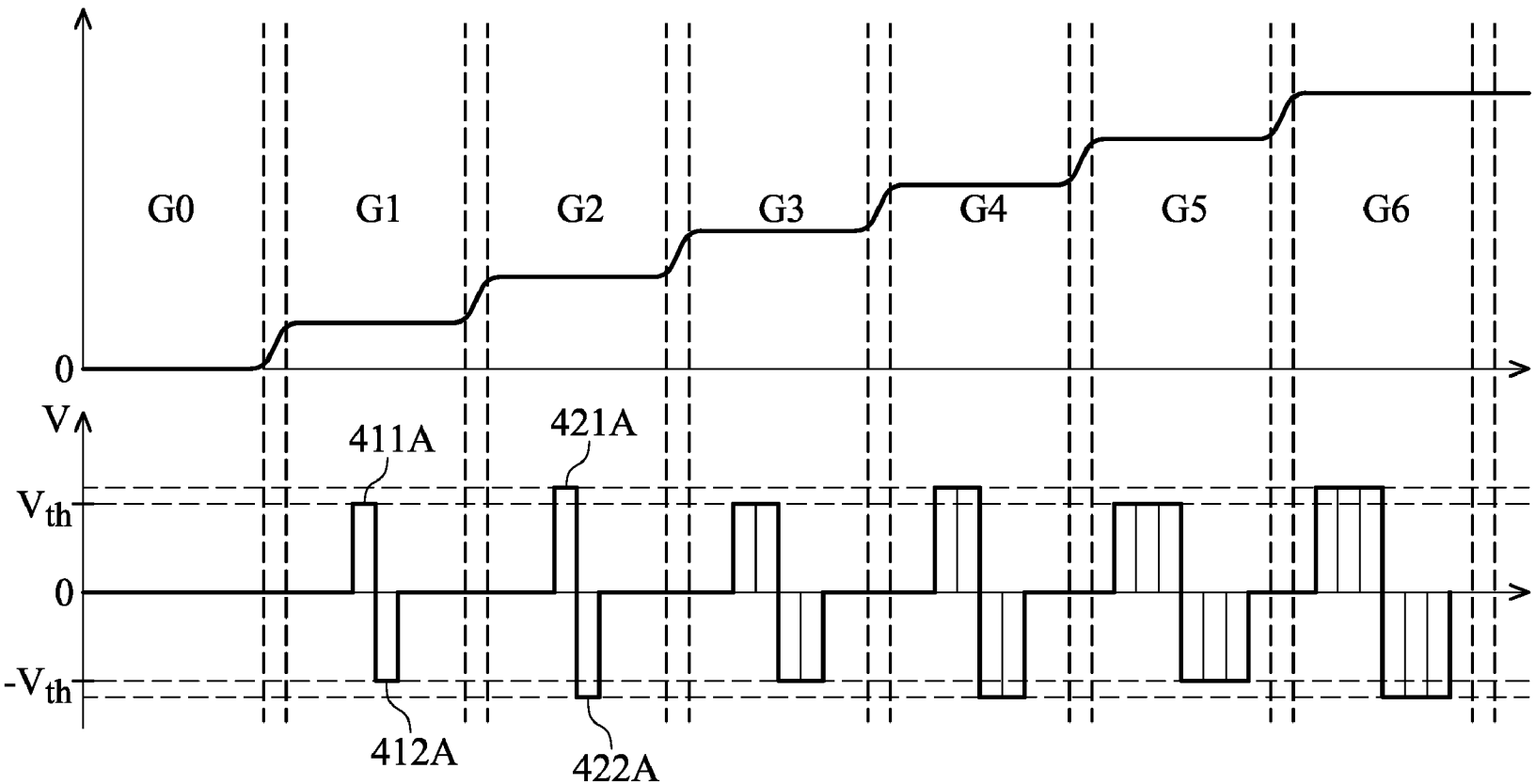
FIGS. 4A and 4B show other relationships between the data signal and the gray level.

Referring to FIGS. 2A~3C, the pulses comprise the same amplitude, but the disclosure is not limited thereto. In other embodiment, the amount of the gray levels can be increased by adjusting the width or the amplitude of the pulse. FIG. 4A shows another relationship between the data signal and the gray level. The amplitudes of the positive and the negative pulses, which correspond to the gray levels G1, G3, and G5, are the same as the amplitudes of the positive and the negative pulses as shown in FIG. 2B.

Referring to FIG. 4A, the width of the pulse 421A is the same as the width of the pulse 411A and the amplitude of the pulse 421A is higher than the amplitude of the pulse 411A. In some embodiments, the width of the pulse 421A may be different from the width of the pulse 411A and the amplitude of the pulse 421A may be the same as the amplitude of the pulse 411A. In this embodiment, the width of the pulse 422A is the same as the width of the pulse 412A and the amplitude of the pulse 422A is higher than the amplitude of the pulse 412A.

Figure 4B:
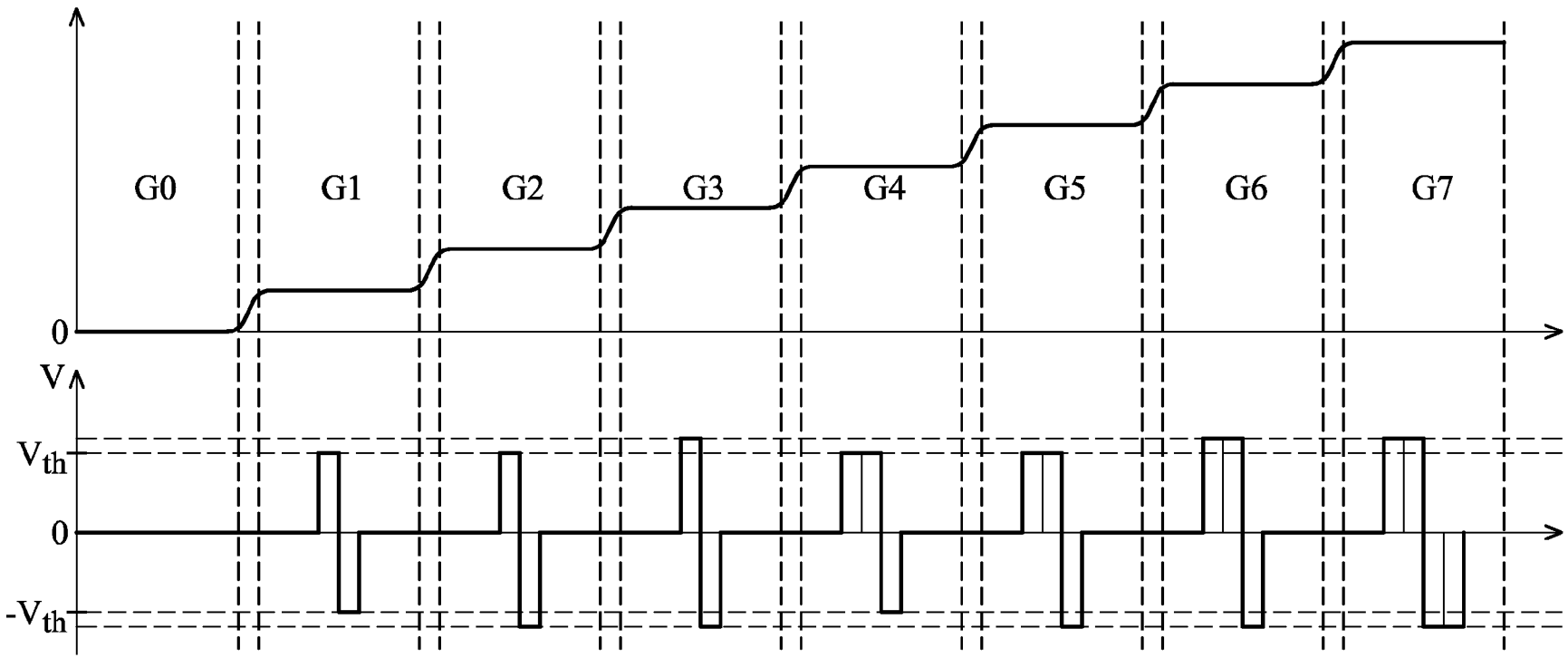

FIG. 4B shows another relationship between the data signal and the gray level. The relationship between the positive pulse and the corresponding negative pulse is shown in FIG. 4B. Thus, the description is omitted.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A driving method for an electro-wetting display (EWD) comprising a source driver and at least one pixel, comprising:

activating the source driver to provide a first data signal to the pixel, wherein the first data signal comprises a first pulse pair comprising a first pulse and a second pulse; and activating the source driver to provide a second data signal to the pixel, wherein the second data signal comprises a second pulse pair comprising a third pulse and a fourth pulse, wherein a width of the first pulse is the same as a width of the second pulse and a polarity of the first pulse is different from a polarity of the second pulse, wherein a width of the third pulse is different from a width of the fourth pulse and a polarity of the third pulse is different from a polarity of the fourth pulse, and wherein the width of the first pulse is the same as the width of the third pulse.

2. The driving method as claimed in claim 1, wherein if a common voltage is served an offset, the first pulse comprises a first polarity and the second pulse comprises a second polarity.

3. The driving method as claimed in claim 2, wherein the common voltage comprises an alternating current (AC) format or a direct current (DC) format.

4. The driving method as claimed in claim 2, wherein the voltage difference between the first pulse and the common voltage is the same as or different from the voltage difference between the third pulse and the common voltage and the voltage difference between the first pulse and the common voltage is the same as or different from the voltage difference between the second pulse and the common voltage.

5. A driving method for a display comprising a source driver and at least one pixel, comprising:

activating the source driver to provide a first data signal to the pixel, wherein the first data signal comprises a first pulse pair comprising a first pulse and a second pulse; and activating the source driver to provide a second data signal to the pixel, wherein the second data signal comprises a second pulse pair comprising a third pulse and a fourth pulse, wherein a width of the first pulse is the same as a width of the second pulse and a polarity of the first pulse is different from a polarity of the second pulse, wherein a width of the third pulse is different from a width of the fourth pulse and a polarity of the third pulse is different from a polarity of the fourth pulse, and wherein the width of the first pulse is the same as the width of the third pulse.

6. The driving method as claimed in claim 5, wherein if a common voltage is served an offset, the first pulse comprises a first polarity and the second pulse comprises a second polarity.

7. The driving method as claimed in claim 6, wherein the common voltage comprises an alternating current (AC) format or a direct current (DC) format.

8. The driving method as claimed in claim 6, further comprising: activating the source driver to provide a third data signal to the pixel, wherein the third data signal comprises a third pulse pair comprising a fifth pulse and a sixth pulse.

9. The driving method as claimed in claim 8, wherein the width of the third pulse is different from a width of the fifth pulse.

10. The driving method as claimed in claim 8, wherein the width of the fourth pulse is the same as the fifth pulse.

11. The driving method as claimed in claim 8, wherein the voltage difference between the first pulse and the common voltage is the same as or different from the voltage difference between the third pulse and the common voltage and the voltage difference between the first pulse and the common voltage is the same as or different from the voltage difference between the second pulse and the common voltage.

12. An electro-wetting display (EWD), comprising:

at least one pixel;

a gate driver providing a gate signal to the pixel; and a source driver providing a first data signal and a second data signal to the pixel, wherein the first data signal comprises a first pulse pair comprising a first pulse and a second pulse, the second data signal comprises a second pulse pair comprising a third pulse and a fourth pulse, wherein a width of the first pulse is the same as a width of the second pulse and a polarity of the first pulse is different from a polarity of the second pulse, wherein a width of the third pulse is different from a width of the fourth pulse and a polarity of the third pulse is different from a polarity of the fourth pulse, and wherein the width of the first pulse is the same as the width of the third pulse.

13. The EWD as claimed in claim 12, wherein the pixel receives a common voltage and when the common voltage is served an offset, the first pulse comprises a first polarity and the second pulse comprises a second polarity.

14. The EWD as claimed in claim 13, wherein the common voltage comprises an alternating current (AC) format or a direct current (DC) format.

15. The EWD as claimed in claim 13, wherein the voltage difference between the first pulse and the common voltage is the same as or different from the voltage difference between the third pulse and the common voltage and the voltage difference between the first pulse and the common voltage is the same as or different from the voltage difference between the second pulse and the common voltage.

16. A display, comprising:

at least one pixel;

a gate driver providing a gate signal to the pixel; and a source driver providing a first data signal and a second data signal to the pixel, wherein the first data signal comprises a first pulse pair comprising a first pulse and a second pulse, the second data signal comprises a second pulse pair comprising a third pulse and a fourth pulse, wherein a width of the first pulse is the same as a width of the second pulse and a polarity of the first pulse is different from a polarity of the second pulse, wherein a width of the third pulse is different from a width of the fourth pulse and a polarity of the third pulse is different from a polarity of the fourth pulse, and wherein the width of the first pulse is the same as the width of the third pulse.

17. The display as claimed in claim 16, wherein if a common voltage is served an offset, the first pulse comprises a first polarity and the second pulse comprises a second polarity.

18. The display as claimed in claim 17, wherein the common voltage comprises an alternating current (AC) format or a direct current (DC) format.

19. The display as claimed in claim 17, wherein the source driver further provides a third data signal to the pixel and the third data signal comprises a third pulse pair comprising a fifth pulse and a sixth pulse.

20. The display as claimed in claim 19, wherein the width of the third pulse is different from a width of the fifth pulse.

21. The display as claimed in claim 19, wherein the width of the fourth pulse is the same as the fifth pulse.

22. The display as claimed in claim 19, wherein the voltage difference between the first pulse and the common voltage is the same as or different from the voltage difference between the third pulse and the common voltage and the voltage difference between the first pulse and the common voltage is the same as or different from the voltage difference between the second pulse and the common voltage.

* * * * *